US008251222B2

(12) United States Patent
Rego Garcia De Alba

(10) Patent No.: US 8,251,222 B2
(45) Date of Patent: Aug. 28, 2012

(54) ENHANCED STRUCTURE FOR PACKING, TRANSPORTATION AND DISPLAY OF DIVERSE PRODUCTS

(75) Inventor: Luis Felipe Rego Garcia De Alba, Mexico City (MX)

(73) Assignee: Power Retailing Group, S.A. DE C.V. (MX)

( * ) Notice: Subject to any disclaimer, the term of this patent is extended or adjusted under 35 U.S.C. 154(b) by 13 days.

(21) Appl. No.: 12/872,563

(22) Filed: Aug. 31, 2010

(65) Prior Publication Data

US 2011/0220544 A1 Sep. 15, 2011

(30) Foreign Application Priority Data

Mar. 12, 2010 (MX) ..... MX/a/2010/002817

(51) Int. Cl.
*B65D 19/38* (2006.01)

(52) U.S. Cl. ..... 206/600; 206/586; 220/4.28

(58) Field of Classification Search ..... 220/4.28, 220/4.33; 206/386, 600, 586; 108/55.1, 108/51.11, 56.1; 211/191, 189
See application file for complete search history.

(56) References Cited

U.S. PATENT DOCUMENTS

| | | | | |
|---|---|---|---|---|
| 4,106,630 | A | 8/1978 | Rosenband | |
| 4,201,138 | A | 5/1980 | Cox | |
| 4,292,901 | A | 10/1981 | Cox | |
| 4,545,490 | A | 10/1985 | Hsiao et al. | |
| 5,386,786 | A | 2/1995 | Kilpatrick et al. | |
| 5,431,336 | A * | 7/1995 | Clee | 229/199 |
| 5,531,326 | A * | 7/1996 | Hummel et al. | 206/509 |
| 5,595,305 | A | 1/1997 | Hart | |
| 5,762,222 | A * | 6/1998 | Liu | 220/1.5 |
| 5,829,189 | A | 11/1998 | Grigsby, Sr. | |
| 6,286,792 | B1 | 9/2001 | Best | |
| 6,938,557 | B1 | 9/2005 | Grigsby, Jr. | |
| 7,472,819 | B1 | 1/2009 | Wachter | |
| 7,584,854 | B2 | 9/2009 | Chandaria | |
| 7,607,566 | B2 | 10/2009 | Philips et al. | |
| 7,628,746 | B2 | 12/2009 | Varanasi | |
| 2005/0109723 | A1 | 5/2005 | Czerwinski | |
| 2006/0131371 | A1 * | 6/2006 | de Alba | 229/162.6 |
| 2007/0102315 | A1 * | 5/2007 | Garcia De Alba | 206/386 |
| 2008/0022905 | A1 | 1/2008 | Trickett | |
| 2008/0264825 | A1 | 10/2008 | Hagan III et al. | |
| 2009/0038989 | A1 * | 2/2009 | Rego Garcia De Alba | 206/736 |
| 2009/0272666 | A1 | 11/2009 | Marcel | |
| 2010/0116178 | A1 | 5/2010 | Harris | |
| 2010/0175596 | A1 | 7/2010 | Scheetz | |
| 2010/0187226 | A1 * | 7/2010 | Rego Garcia De Alba | 220/4.28 |
| 2011/0011312 | A1 * | 1/2011 | Rego Garcia De Alba | 108/55.1 |

FOREIGN PATENT DOCUMENTS

| | | | |
|---|---|---|---|
| WO | 0192121 | A1 | 12/2001 |
| WO | 2006119074 | A2 | 11/2006 |
| WO | 2007048169 | A1 | 5/2007 |
| WO | 2008105647 | A1 | 9/2008 |

* cited by examiner

*Primary Examiner* — J. Gregory Pickett
*Assistant Examiner* — Andrew Perreault
(74) *Attorney, Agent, or Firm* — Brooks Kushman P.C.

(57) ABSTRACT

The present invention relates to a novel enhanced structure for packing, transportation and display of diverse products which allows transporting large volumes of products reliably and efficiently from the point of manufacture to the point of sale, structure that gives various competitive advantages related to the containers already known in the market, with the most important being, the solid structural stiffness which comes from a quick and reliable assembling of the whole structure, which is achieved from the configuration of the fastening gussets that attach the upper and lower frames with the support and containment side posts, and the configuration of the structural profiles that make up both the upper frame and the bottom frame.

10 Claims, 12 Drawing Sheets

ENHANCED STRUCTURE FOR PACKING, TRANSPORTATION AND DISPLAY OF DIVERSE PRODUCTS

The present invention generally relates to assemblies of exhibitors for delivery and display of diverse products. More particularly, the invention relates to assemblies that are used in a structure that allows the packing of diverse products and facilitates transportation from the packing place to the place where products are displayed to the final consumer, without requiring that exhibition involve removing said products from the containing packing.

BACKGROUND OF THE INVENTION

Traditionally the packing has been understood as the covering that temporarily contains products, and serves mainly to group units of product in management, transportation and storage.

Technically packing is classified into container or primary packing, which is in direct contact with the product; secondary packing that groups a plurality of packaged products in order to form a bigger load, storage or transportation unit, with this secondary packing being where the tray, the box pallet, the display box, the carton, the wood box, the plastic box, the built-in rack box, the box with lid, the box with lid and bottom, the tabs box, the basket, the case, the plastic film and the paper sack, among others are comprised, whose structural configuration meets the requirements to be resistant, protect and preserve the product; and finally the tertiary packing comprising several secondary packing elements.

Within the context of the search for new proposals for packing and transportation of diverse products, multiple modifications and reconfigurations to the traditionally used secondary packing have been developed; a example is disclosed in the patent document U.S. Pat. No. 7,628,746 B2 to Aditya Varanasi, granted on Dec. 8, 2009, wherein a shipping container made of cardboard that becomes an exhibitor is disclosed and protected, using punched lines and previously cut openings that define together a line which circumscribes the cardboard container, which is in any location where the punched line crosses an edge of cardboard container or another punched line, providing a previously cut opening a clean separation. Furthermore, in this container-exhibitor no section of the perforated lines is parallel to an adjacent folding line.

Another document of interest in relation to the inventions is the U.S. Pat. No. 7,607,566 B2 to Nicholas A. Philips and Jeffrey A. Smith, granted on Oct. 27, 2009, in which is being disclosed a container for shipment and exhibition of products and its associated containment space, wherein the containment space of the container includes a plurality of side panels, lower and upper panels, that are erected within an annex shipping container, forming in some of the side and upper panels, removable outward window panels.

As far as it is concerned, the U.S. Pat. No. 7,584,854 B2 to Ashok V. Chandaria, granted on Sep. 8, 2009, protects a shipping and display assembly for a plurality of complementary primary and secondary products such as wrapping paper and adhesive tape, wherein the assembly includes a box that has a first section and a second section that are connected each together for shipping and are detachable to display products. The first section includes a first compartment to support and display the primary products, and a second compartment to support and display the secondary products. The second section of the exhibition assembly retains primary and secondary products within the first and second compartments during shipment and is removed when products must be displayed.

Furthermore, aside from the vast examples included in the technical field to which the present invention belongs is found in the U.S. Pat. No. 7,472,819 to Richard G. Wachter, dated on Jan. 6, 2009, wherein was granted protection to a container for shipment and exhibition whose retaining area is defined from a folding material, so that when the container is finished it includes a visible section on the front panel; likewise the side panel and the rear panel have both internal and external shapes, while the side panel includes at least one partial intermediate side panel, so that the side multi-panels and the rear panel give the necessary strength and stability to the container.

According to the state of the art previously discussed, most containers for packing, shipping, and exhibition of products, including the most novel, are made from a single concept which consists of preparing a folding material that covers and protects in it all the subject products, so that after the transportation process, i.e. when there is no latent risk of damaging the products, some parts of said folding material are removed forming exhibition windows.

The above mentioned, seems to be a practical and economic alternative solution for packing, shipping, and exhibition of diverse products; however the fact of the vast majority that the containers until now known, define their structural strength from the product characteristics they contain must be considered, thus, it is logical to understand that a sheet of folding material, which mostly is cardboard, is not enough to protect the products comprised inside, limiting their real application to only keeping together the products desired to be transported, this could be achieved with the simple application of a transparent plastic film around the products that is desired to be kept together.

Besides the above, there is a second disadvantage when the containers of the state of the art are used, and this becomes real when it is necessary to remove certain parts comprising them in order to be able to exhibit the products contained therein, i.e., to open the exhibition windows allowing the end-user to appreciate the contained products, which is double work since the container first must be assembled for packing and transportation of the products and second, the parts of the container that allow the display of products must be removed.

While the fact of detaching some segments of the container for open exhibition windows could not be complex since such sections are previously cut, it is a problem that once those segments are removed from the container, it will lose structural strength characteristics, and worse greatly limit their ability to safely transport the products contained, thus becoming a container that can be used only once, i.e. a disposable container.

Due to aforesaid arises the need for a enhanced structure for packing, transportation and display of products that provides a greater structural strength, reusable, easy to assemble, and does not require any modification from the packing stage to the exhibition of products to the end user.

In fact, a first attempt to achieve the above is disclosed in patent MX269583, owned by the same inventor of the enhanced structure object of the present application, which discloses and protects a display packing easily collapsible, characterized in that it is comprised of a lower frame shaped from four horizontal angular elements related to the horizontal plane inward and at the bottom, attached in the ends by fittings comprising horizontal planes and vertical planes, the fitting remaining inside the apex and joining the vertical planes of the horizontal angular elements by attaching means fixing said planes to the vertical planes of the fittings and the horizontal planes of the horizontal angular elements fixed by attaching means to the horizontal planes of the fitting; a fitting is located in each corner of the frame; each fitting has two segments, the inner one separate from the vertical plane of the horizontal angular element, remaining a slit where will slide an end of an angular vertical element with slots in order to surround one of the attaching means, and a segment abutting with the vertical plane of the horizontal angular element; each corner is provided with a vertical angular element and in its free ends are inserted the corners of an upper frame with the same structure of the lower; finally the secondary packing includes diagonal tensors in each of the diagonals of the surfaces formed by vertical angular elements and horizontal angular elements.

Even though the above described display packing meets the sought requirements of structural strength, reuse, and display of products to the end-user without structural modifications, as a result of various technical analysis processes, it has been possible to arrive at a meaningful and innovative improvement of the features which comprises it, particularly the structural shape of the upper and bottom frames, the attaching elements and the arrangement of the tensor elements, giving rise to a new enhanced structure for packing, transportation and display of diverse products, with which are intended as follows:

OBJECTS OF THE INVENTION

It is an object of the present invention, to provide a enhanced structure for packing, transportation, and exhibition of diverse products, that allows packing of large volumes of products.

Another object of the present invention is to provide a enhanced structure for packing, transportation and display of diverse products that based on its structural strength characteristics, allows the transportation of large volumes of products, safely, efficiently, and without disarrangement or damage to the transported products.

Another object of the present invention is, to provide a enhanced structure for packing, transportation, and display of diverse products, that allows display of the products it contains from the time of packing to the end-user presentation, without modification of shape, structure, or position of the structure implied.

Another object of the present invention is to provide a enhanced structure for packing, transportation and display of diverse products that based on structural elements that make it up is easy to assembly and disassembly.

Another object of the present invention is to provide a enhanced structure for packing, transportation, and display of diverse products in which the structural elements that make it up practically can be replaced when they are damaged, enabling reuse of the structure.

Yet another object of the present invention is to provide a enhanced structure for packing, transportation and display of diverse products made from lightweight materials that allow easy handling of the frame.

SUMMARY OF THE INVENTION

The present invention relates to a novel enhanced structure for packing, transportation and display of diverse products which allows transporting large volumes of products reliably and efficiently from the point of manufacture to the point of sale, structure that gives various competitive advantages related to the containers already known in the market, with the most important being, the solid structural stiffness which comes from a quick and reliable assembling of the whole structure, which is achieved from the configuration of the fastening gussets that attach the upper and lower frames with the support and containment side posts, and the configuration of the structural profiles that make up both the upper frame and the bottom frame.

A second advantage of the enhanced structure for packing, transportation, and display of diverse products, is reflected in that it is practical with the help of the fastening gussets to dispose of at least a pair of diagonal tensors in each of the four sides of the structure, which is achieved substantially increases structural strength.

Another of the conferred advantages is the savings of material from the innovative design of the structure, since a single structure is used from the factory to the point of sale.

Other aspects and advantages of the present invention will be clear and evident from the detailed description of the invention and the drawings that are annexed with illustrative and not limitative character, and which are presented in the following.

DETAILED DESCRIPTION OF THE INVENTION

Figure 1:
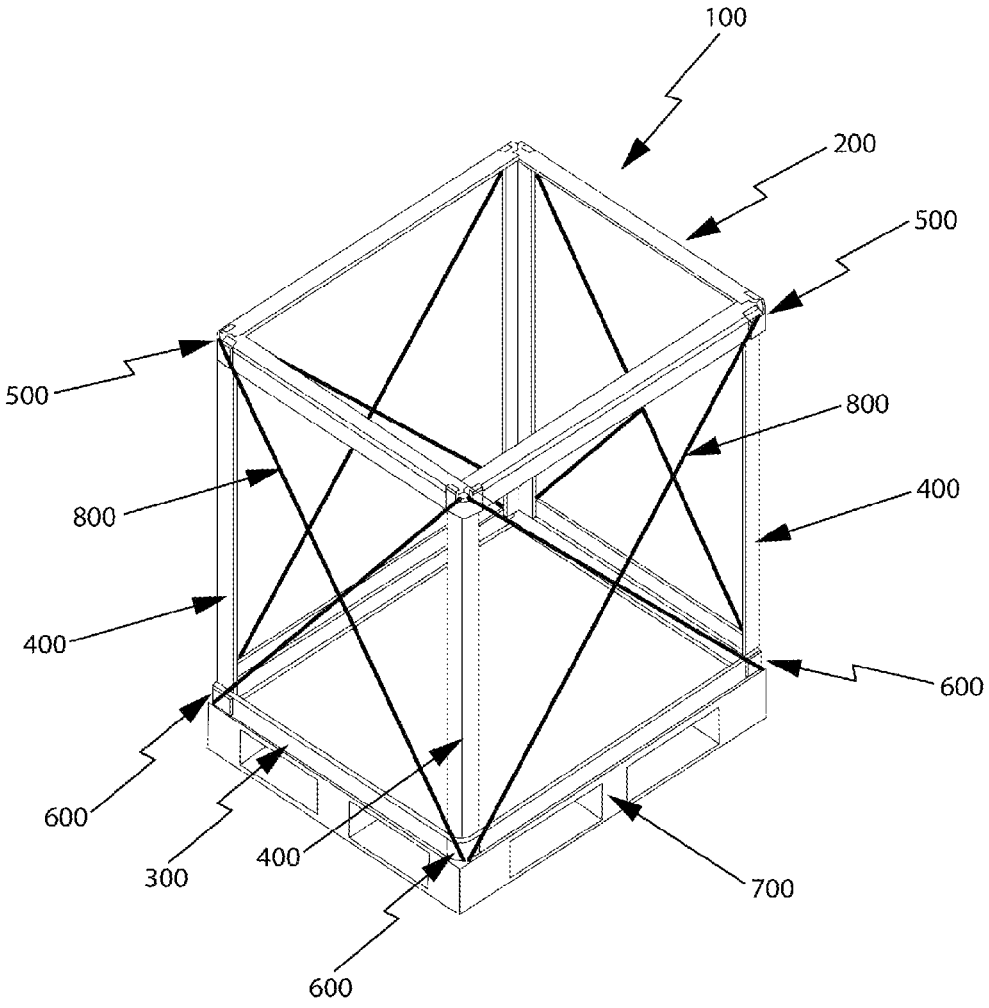
FIG. 1 shows a conventional perspective of a enhanced structure for packing, transportation, and display of diverse products carried out in accordance with the present invention, made according to the present invention mounted on a pallet.
Figure 2:
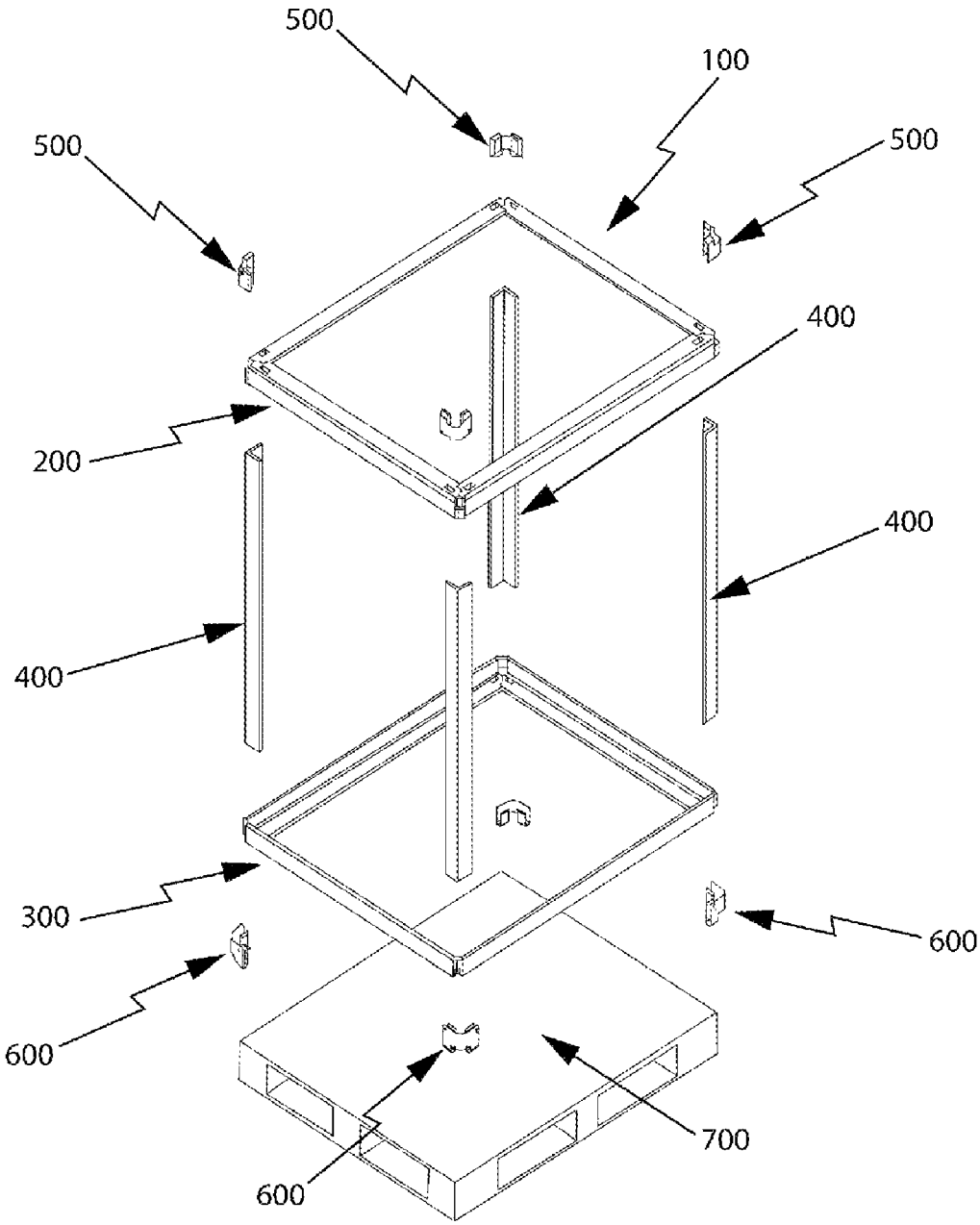
FIG. 2 shows an exploded view of the structure of FIG. 1.

According to what is illustrated in FIGS. 1 and 2, the enhanced structure for packing, transportation and display of diverse products 100, object of the present patent application, hereinafter called structure 100, is comprised of a first upper rectangular frame 200 and a second rectangular bottom frame 300 which are kept together by means of four support and containment side posts 400, disposed in each corner of said upper 200 and bottom 300 frames, where the perimeter dimensions of the frames define in combination with the length dimensions of the four support and containment side posts 400, the volume of the structure 100 and therefore their ability for containment, transportation and display. Each one of the support and containment side posts 400 is a straight post of "L" shaped cross-section and is attached to a corner of the upper frame 200 by means of a first fastening gusset 500 and to a corner of the lower frame 300 by means of a second fastening gusset 600, wherein each one of the first fastening gussets 500 have the same structural shape than the second fastening gussets 600, the first ones differentiated from the second ones fastening gussets with the purpose of identifying only that while some of them allow to hold the upper end of a support and containment side post 400 to a corner of the upper frame 200, the other ones allow to hold the lower end of said post 400 to a corner of the lower frame 300.

In addition and with the object of strengthening the load capacity of the structure 100, tensor elements 800 have been disposed alternately between the first fastening gussets 500 and the second fastening gussets 600, these in combination defined two diagonal tensors intersecting in "X" shape, for each one of the front, right side, left side and rear faces of the structure 100.

Thus, once the structure 100 has been built from each one of the elements above defined, it is placed on a pallet 700, by means of which it is possible to handle it with a fork lift (not illustrated).

Figure 4:
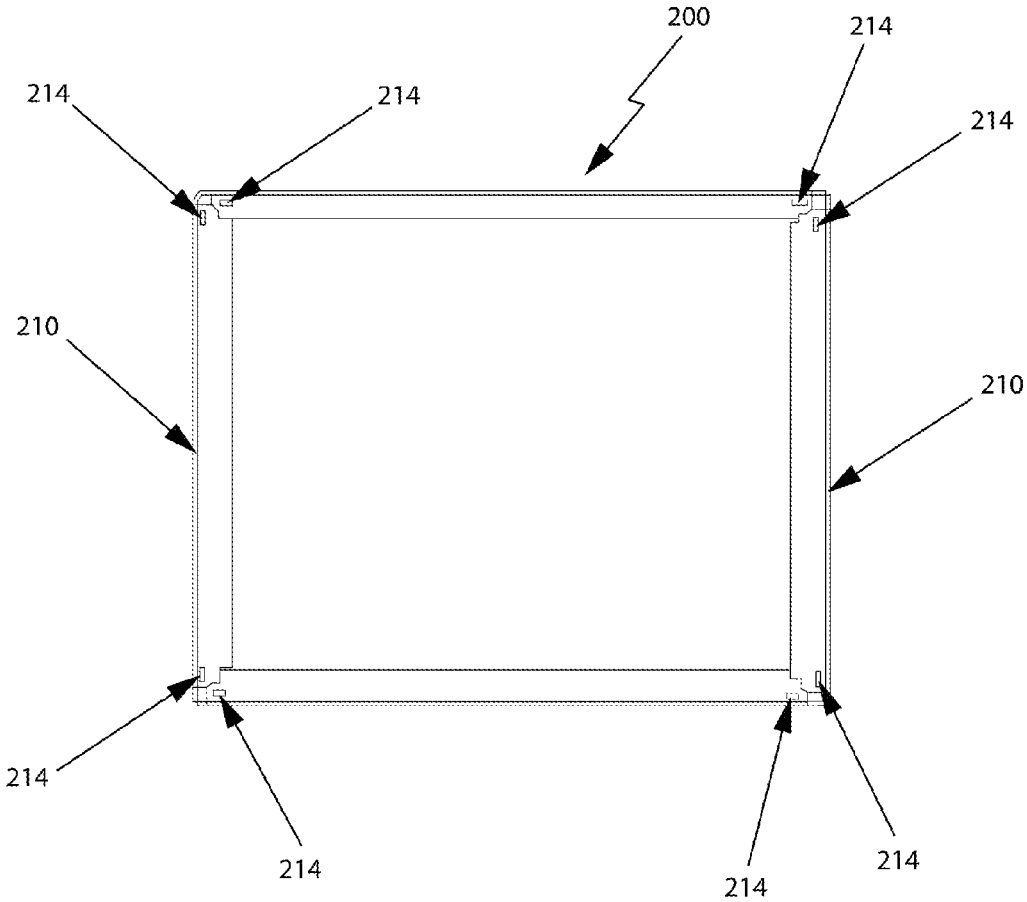
FIG. 4 shows a top plan view of the profiles of FIG. 3 in its folded position, forming either the upper frame or the bottom frame of the structure of FIG. 1.

Both the upper frame 200 and the bottom frame 300 of the structure 100 have the same shape, and each one is conformed from a pair of structural profiles 210 bent in square shape and attached in their free ends; thus, in order to avoid unnecessary repetition, suffice it to say that once assembled a frame with two profiles 210, as the frame shown in FIG. 4, the upper or bottom position of the same depends on the position of the structure 100, with up-down orientation.

Figure 3:
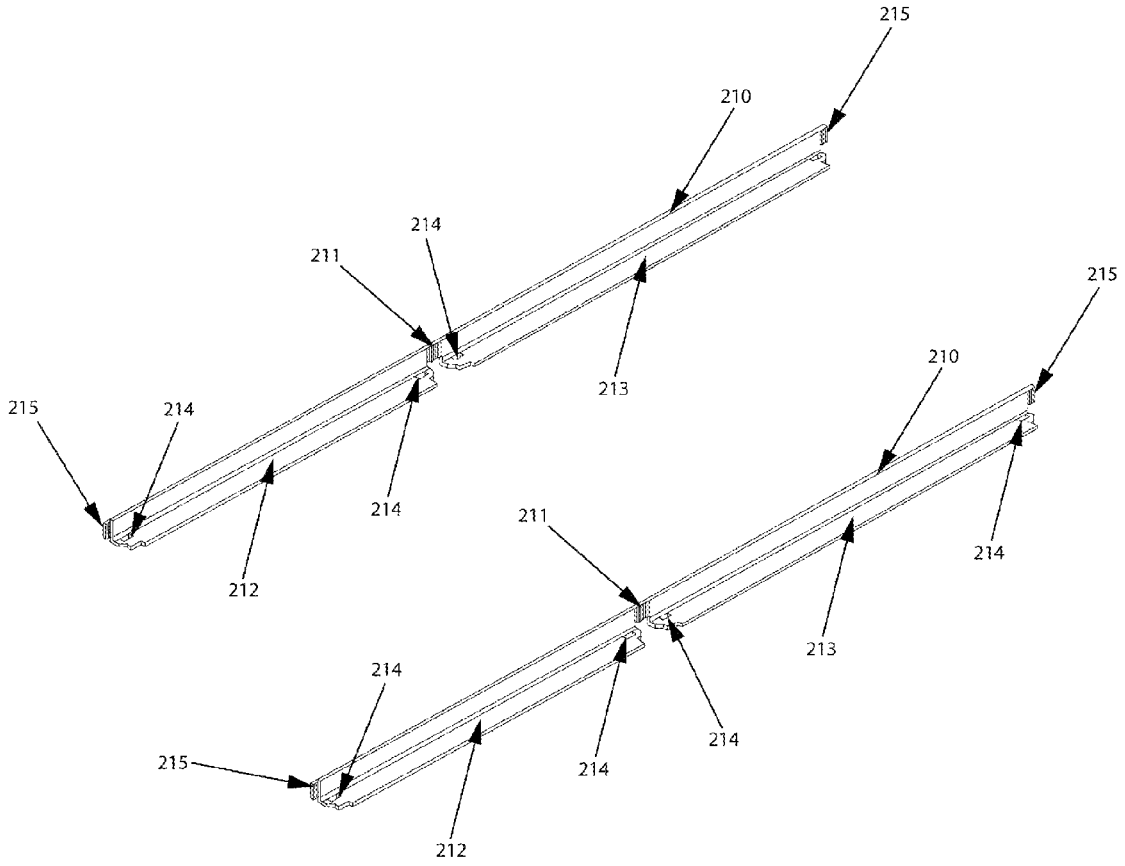
FIG. 3 shows a conventional perspective of a pair of structural profiles in its extended position, from which are conformed both the upper frame and the bottom frame of the structure of FIG. 1.
Figure 4A:
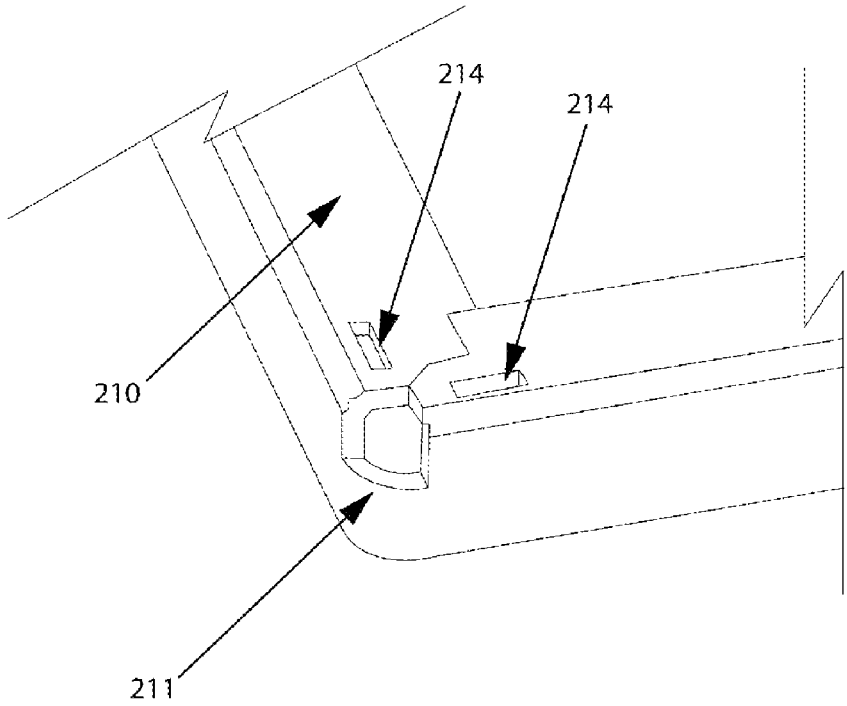
FIG. 4A, shows a conventional perspective of the external part of the ply made in the central portion of one of the structural profiles from which are conformed both the upper frame and the bottom frame of the structure of FIG. 1.
Figure 4B:
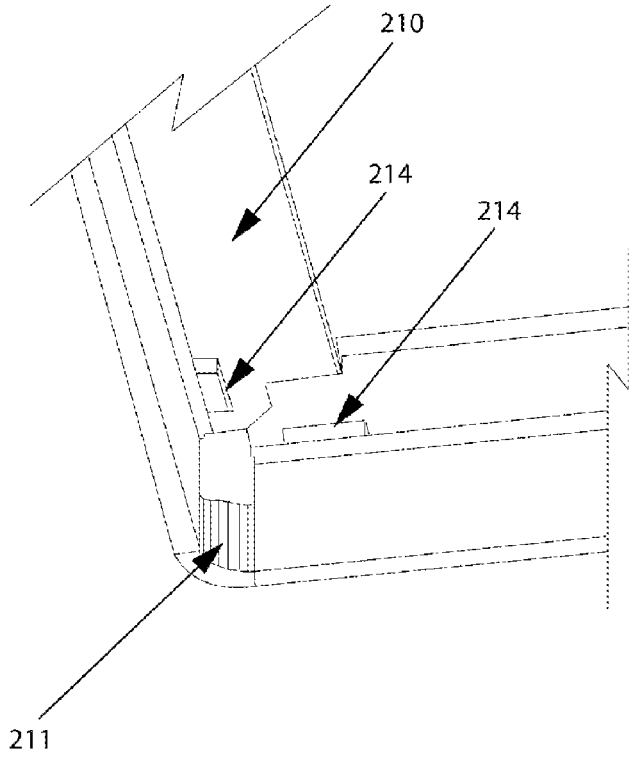
FIG. 4B, shows a conventional perspective of the internal part of the ply made in the central portion of one of the structural profiles from which are conformed both the upper frame and the bottom frame of the structure of FIG. 1.

As illustrated in FIGS. 3, 4A and 4B, each of the structural profiles 210 comprises an "L" shaped cross-section, in the vertical wall of which and beyond of its central part, inclined to its left end, a folding section 211 is shaped from a plurality of weakening lines and the removal of a portion of said vertical wall material, so that together facilitate to fold in this section, the structural profile 210 up to reach an angular position of 90° between the sections of the profile 210 defined before and after of the folding section 211.

Complementarily to the previously defined folding section 211, in the horizontal wall of the structural profile 210 has been made the removal of a portion of material, so that such removal of material gives rise to a first section of horizontal wall 212 and a second section of horizontal wall 213, with each of said horizontal wall sections having at its ends abutting with the folding section 211, a stepped termination which allows a perfect coupling of both horizontal wall sections when the 90° fold of the structural profile 210 is made.

Figure 4C:
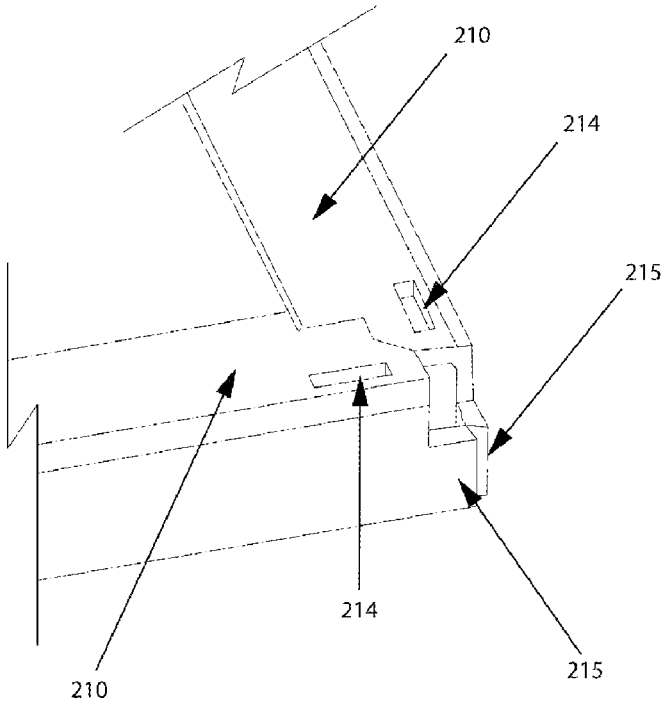
FIG. 4C, shows a conventional perspective of the attachment of the end portions of the structural profiles from which are conformed both the upper frame and the bottom frame of the structure of FIG. 1.

Also each one of said first 212 and second 213 horizontal wall sections have in each end abutting with the folding section 211 and close to its part abutting with the vertical wall, a retention slot 214 through which it will be possible to secure a fastening gusset 500 that will attach a corner of the shaped frame with a support and containment side post 400; meanwhile in its terminal ends each one of these horizontal wall sections also has a stepped termination and two retention slots 214 that allow coupling with the horizontal terminal ends of a second structural profile 210 such as that shown in FIG. 4C, so as to conform in this manner one of the frames of the structure 100. Furthermore, each one of the terminal ends of the vertical wall is shaped so that there is a small flange 215 through which and in combination with the retention slots 214 shaped in the horizontal wall of each one of the structural profiles 210, it is possible to attach by means of a fastening gusset 500 the terminal ends of two structural profiles 210, thus forming one of the two frames that make up the structure 100.

In a preferred embodiment of the invention, the structural profiles 210 and the support and containment side posts 400 are produced from cardboard.

Figure 5:
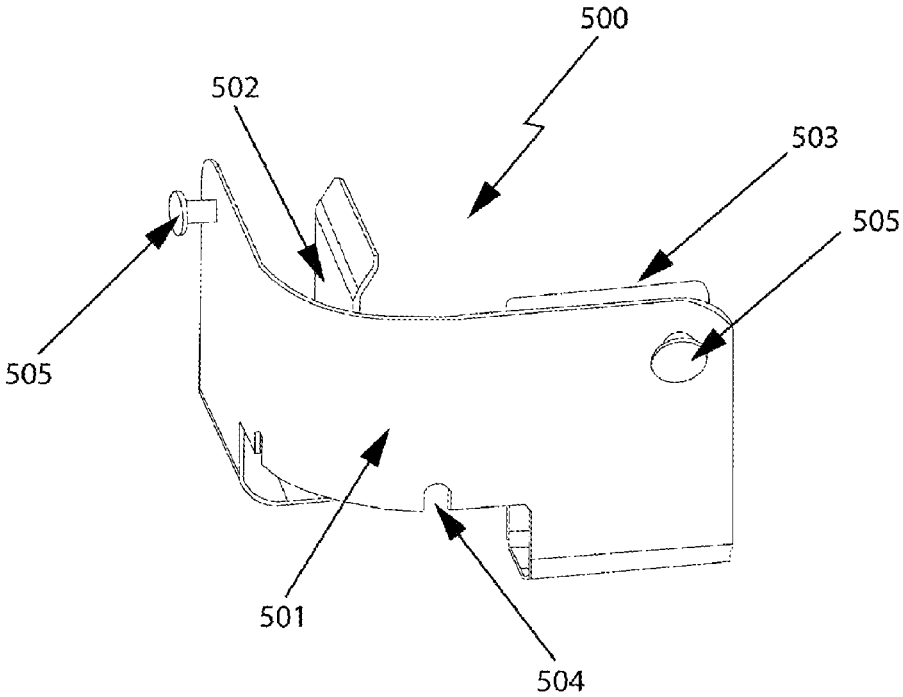
FIG. 5, shows a conventional perspective of a first fastening gusset of the structure of FIG. 1.
Figure 6:
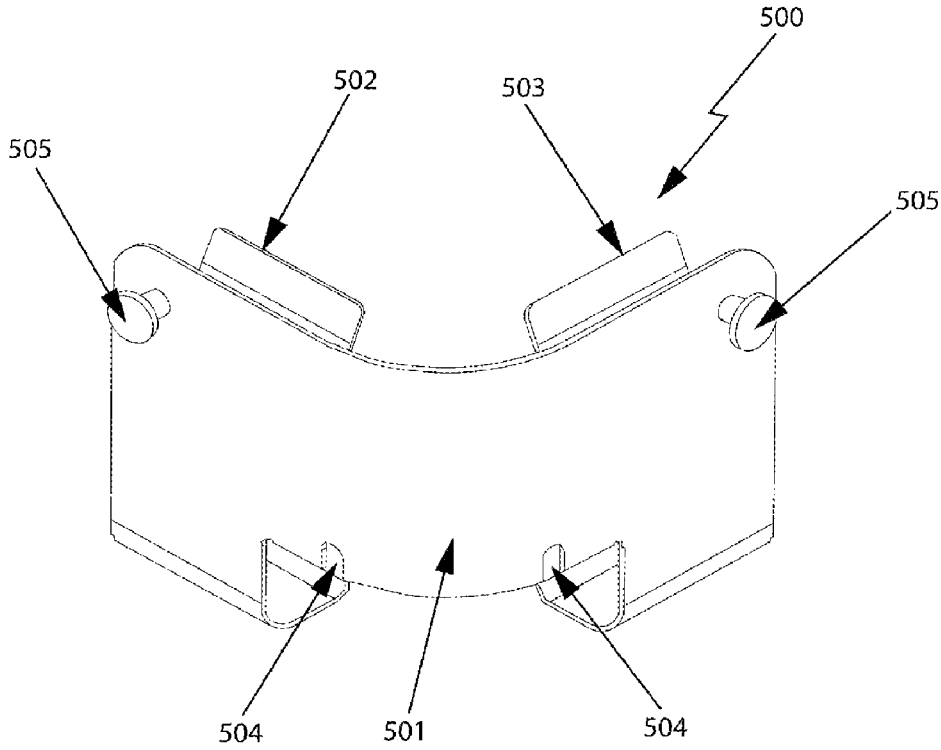
FIG. 6 shows a conventional perspective of the front part of the fastening gusset of FIG. 5
Figure 7:
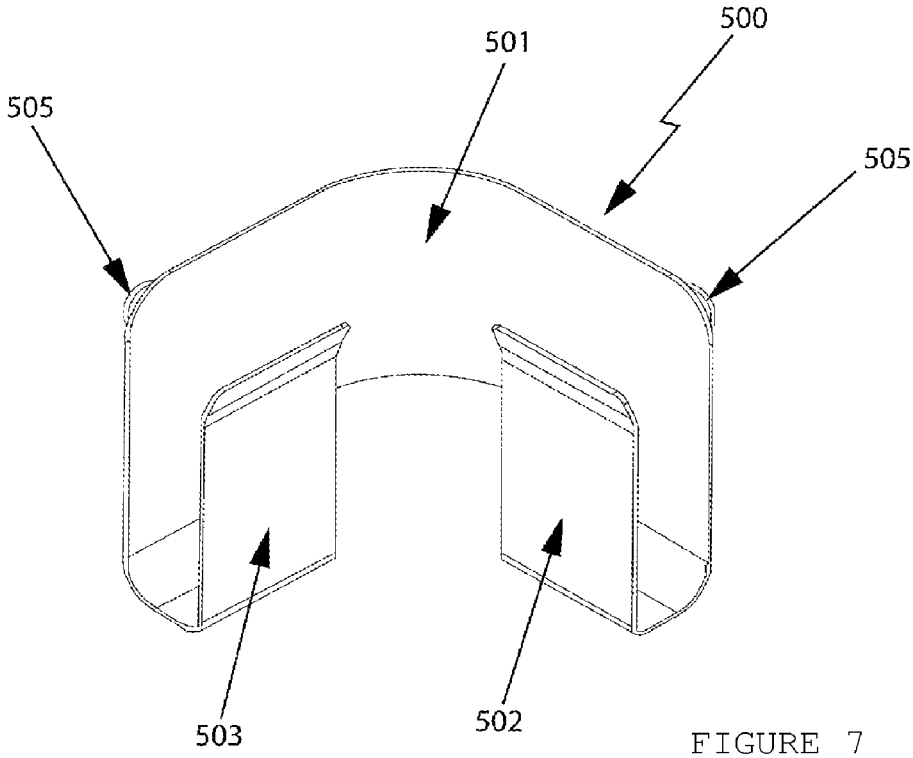
FIG. 7 shows a conventional perspective of the rear part of the fastening gusset of FIG. 5

Insofar as the fastening gusset 500 attaching each corner of the upper 200 and lower 300 frames of the structure 100 with the support and containment side posts 400, and even allows the attachment of the two structural profiles 210 from which, each one of said frames is conformed, according to what is illustrated in FIGS. 5 to 7, said fastening gusset 500 in addition to attach elements, provides for a greater resistance to the structure 100 and allows it to set up quickly and reliably, making it possible to replace damaged parts for the reuse of said structure 100; it is shaped from a moulded one piece, through which a rounded main wall 501 is defined, whose side ends are projected towards the rear part with a fold in "U" shape, in order to conform a left insertion paddle 502 and a right insertion paddle 503, finishing each one of said insertion paddles with a portion of material which is projected outwards and allowing easy arranging of the support and containment side posts 400 of "L" shaped cross-section into the interior of the space defined between each one of said insertion paddles and the rounded main wall 501.

At the medium part of the rounded main wall 501 of the fastening gusset 500, a pair of slots 504 have been conformed, which in combination with a pair of anchors 505 disposed for such purpose in the right and left upper ends of said rounded main wall 501, allow the placement and retention of the tensor elements 800 which in particular are diagonal tensors intersecting in "X" shape for each one of the front, right side, left side and rear faces of the structure 100.

Figure 8:
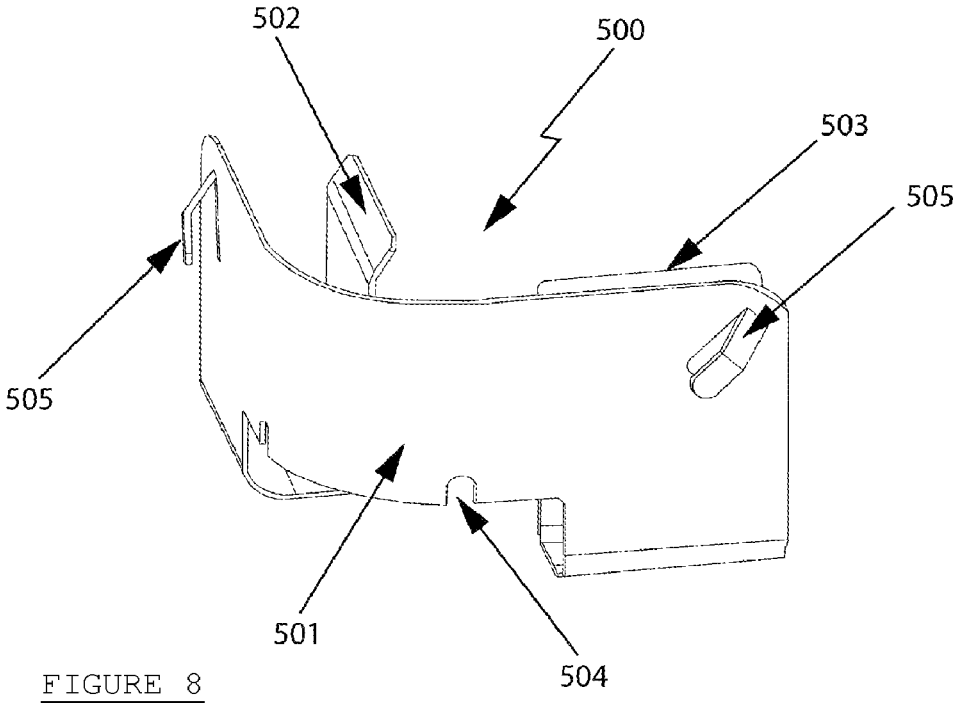
FIG. 8, shows a conventional perspective of a second fastening gusset of the structure of FIG. 1
Figure 9:
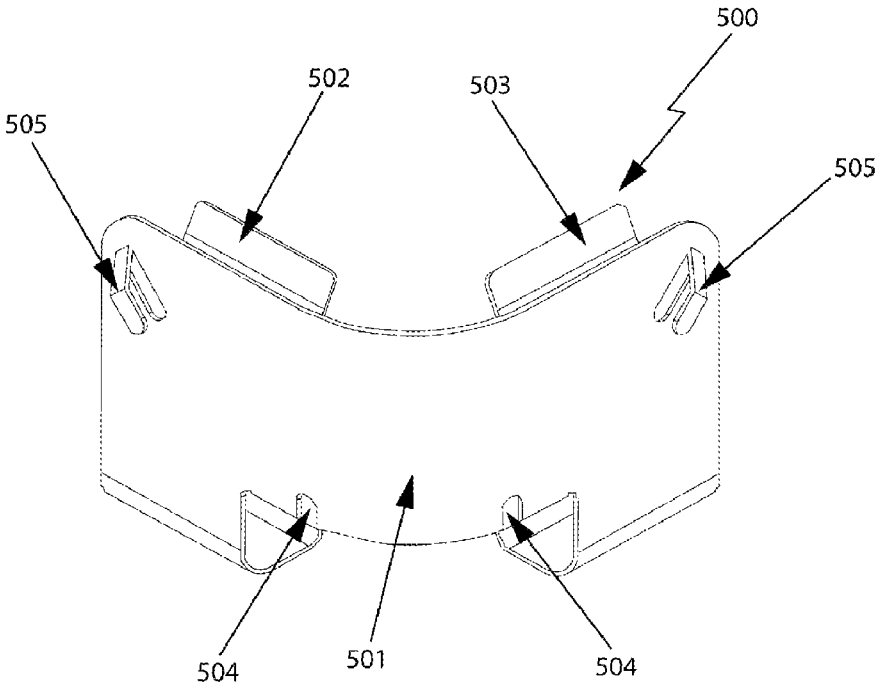
FIG. 9, shows a conventional perspective of the front part of the fastening gusset of FIG. 8.
Figure 10:
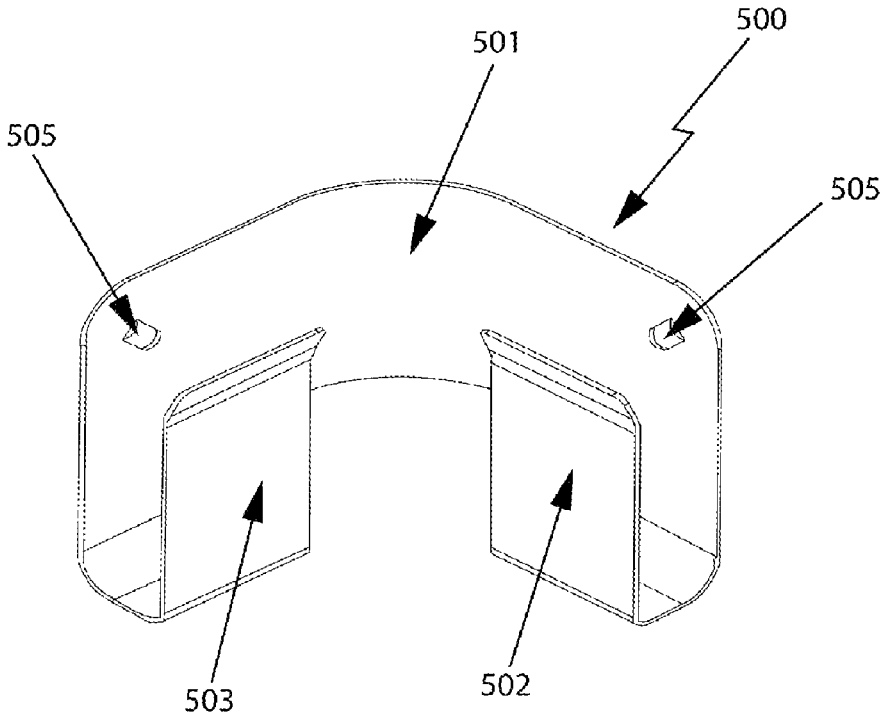
FIG. 10, shows a conventional perspective of the rear part of the fastening gusset of FIG. 8.

In a first preferred embodiment of the invention, is envisioned that the anchors 505 are defined from bolts, however, the use of bolts should not limit the scope of the invention, since as shown in FIG. 8 to 10, said anchors 505 can be in a second embodiment of the present invention defined from hooks.

In a preferred embodiment of the invention, the fastening gusset 500 is made preferably of metal, plastic, nylamid, laminated cardboard, or polymers.

Once the elements integrating the structure 100 are defined, it is time to address the aspect of its assembly, prior to which, it is important to bear in mind that what is described below is intended for the attachment of the four corners integrating one of the two frames with the support and containment side posts 400 through a fastening gusset 500 because of which, in order to achieve the total integration of the structure 100, must be repeated the described action, four times regards to the upper frame 200 and four times regards to the bottom frame 300.

Figure 11:
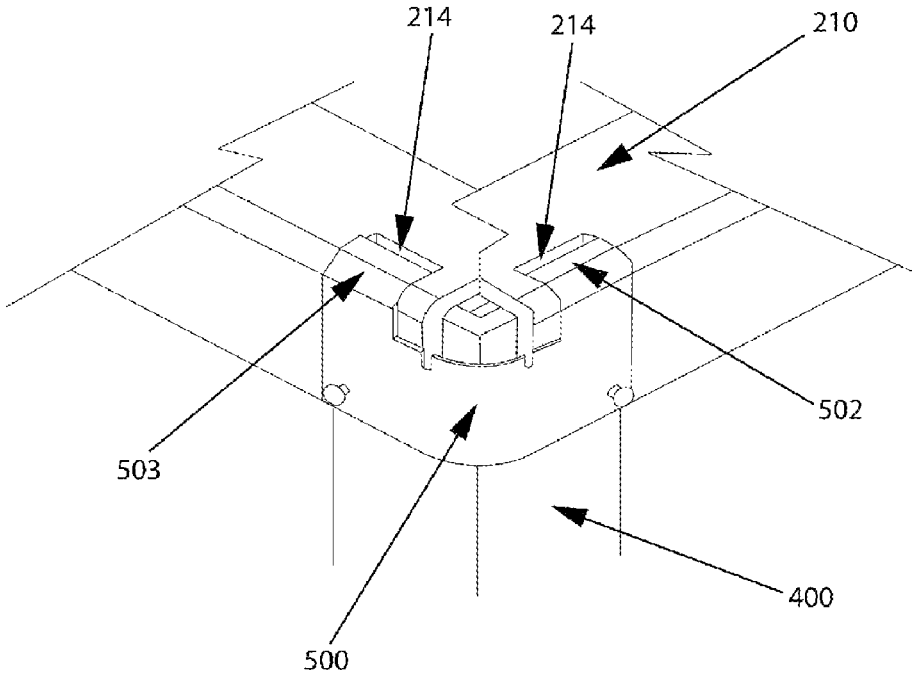
FIG. 11, shows a conventional perspective of a corner of the upper frame of the structure of FIG. 1, when said corner is attached to a support and containment side post by means of a fastening gusset profile.
Figure 12:
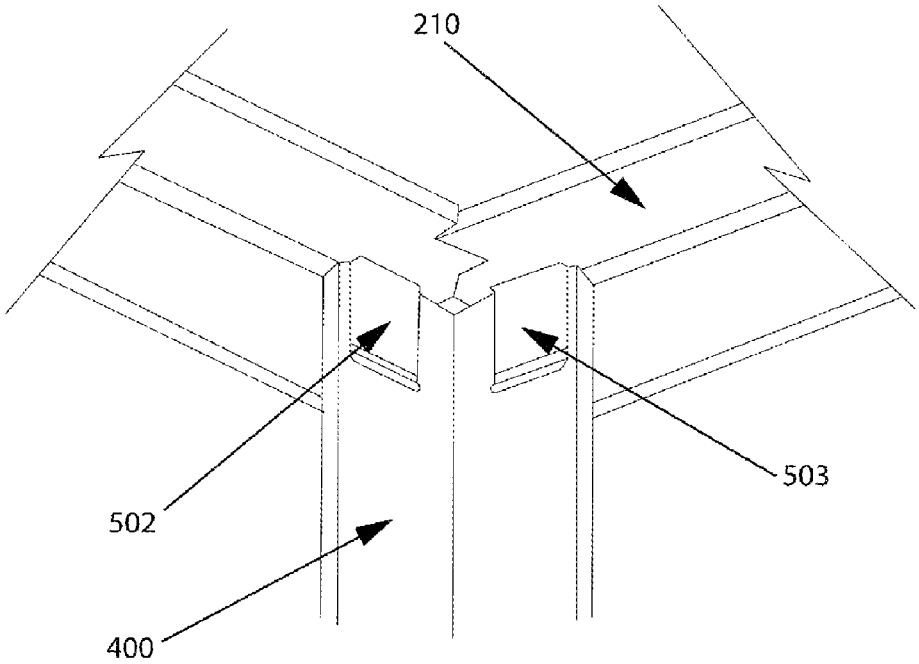
FIG. 12, shows a conventional perspective of an inner part of a corner of FIG. 11, when it is attached to a support and containment side post by means of a fastening gusset profile.
Figure 13:
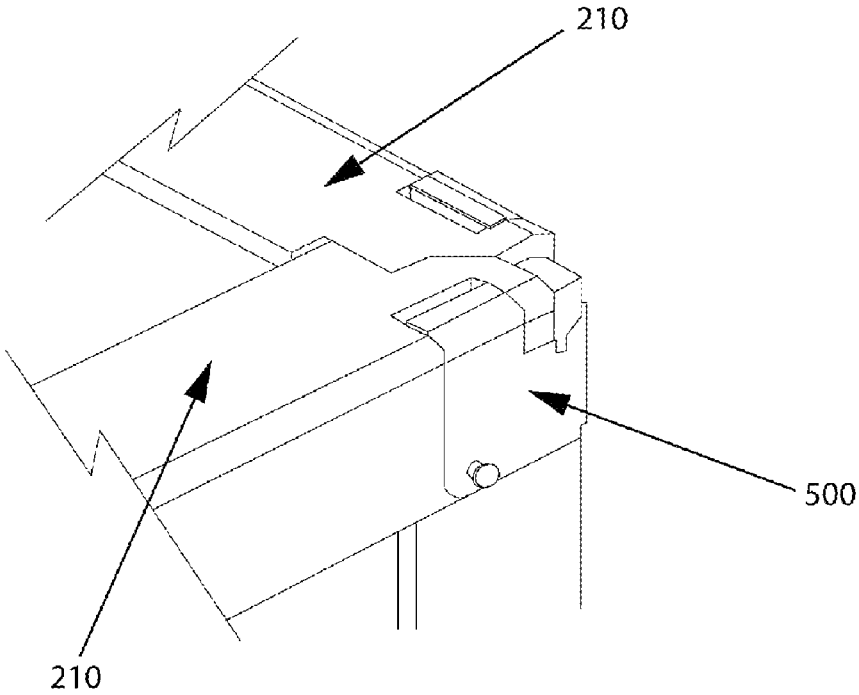
FIG. 13, shows a conventional perspective of a corner adjoining to the corner of FIG. 11, when it is attached to a support and containment side post by means of a fastening gusset profile.

As may be noted from FIGS. 11 to 13, once two structural profiles 210 are folded and the upper frame 200 is formed, the support and containment side posts 400 are placed in each corner of said frame, in order for the retention slots 214 remain arranged so that the left 502 and right 503 insertion paddles of the fastening gusset 500 may be inserted, so that, primarily through the gusset 500 the two intermediate ends of a structural profile 210 remain attached or the two terminal ends of two structural profiles 210 that are attached, and secondly, taking in account the design of the fastening gusset 500 when the left 502 and right 503 insertion paddles are inserted in the retention slots 214, the post 400 are fixed to the upper frame 200 and thus resulting in the structure 100.

Finally, depending on the embodiment, the tensors 800 are attached to the bolts or hooks defined by the anchors 505 of the fastening gusset 500.

Figure 14:
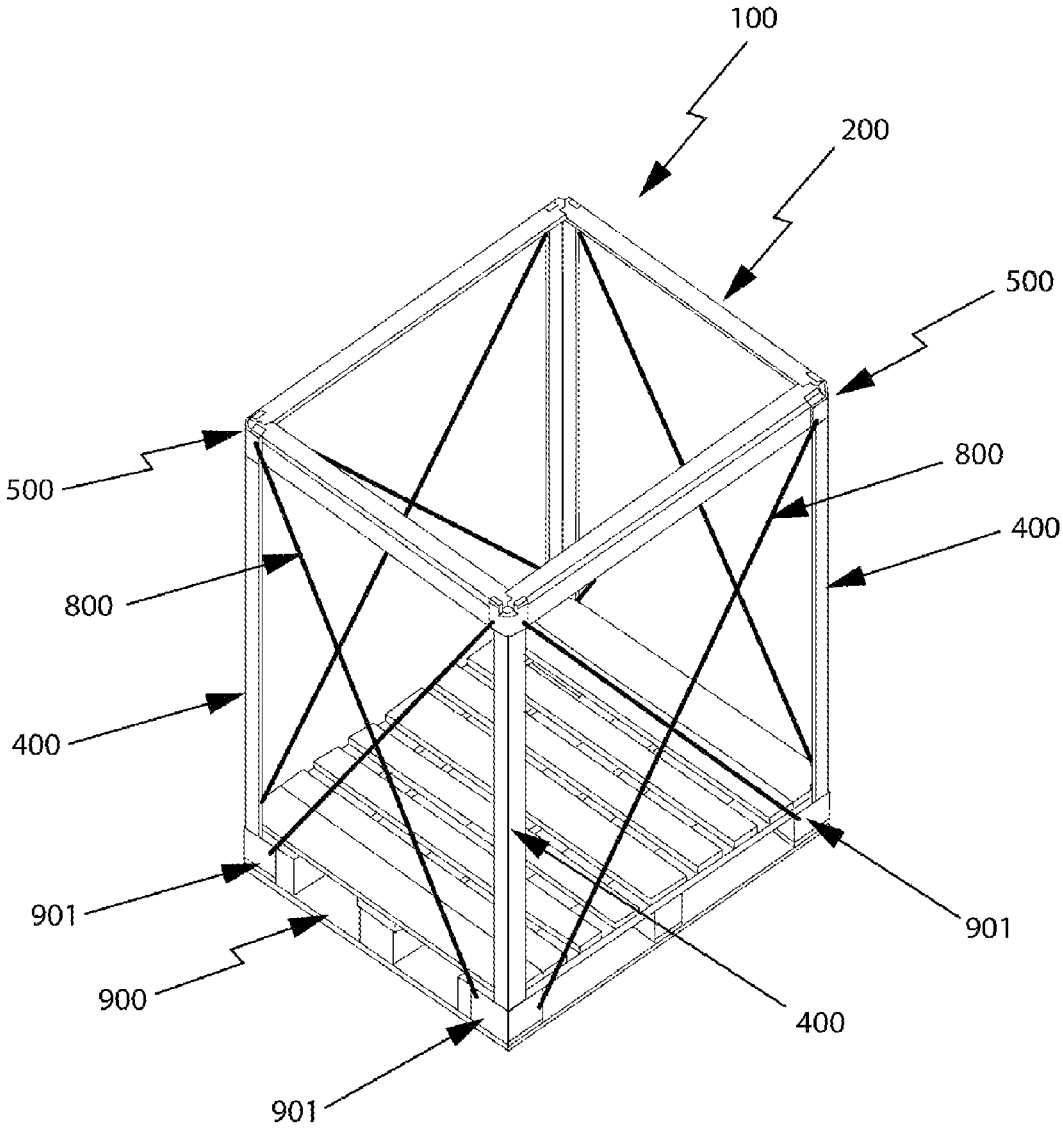
FIG. 14, shows a conventional perspective of a preferred embodiment of the invention.
Figure 15:
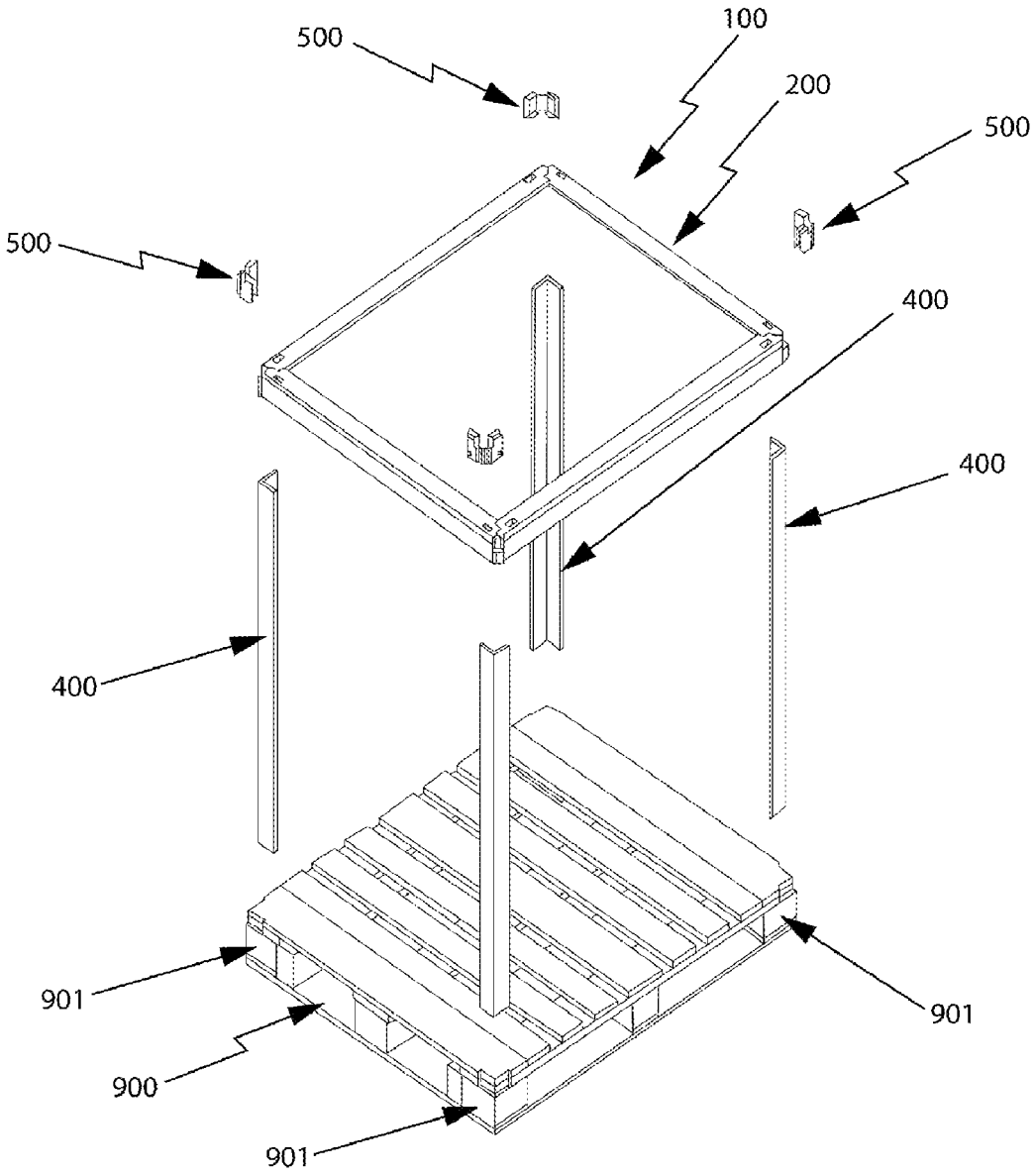
FIG. 15, shows an exploded view of the embodiment of FIG. 14.

In another preferred embodiment of the present invention, and in accordance with what is illustrated in FIGS. 14 and 15, a pallet 900 supporting the structure 100, is configured so that it comprises four corner wedges 901 receiving directly four support and containment side posts 400, i.e. the four corner wedges 901 of the pallet 900, defining together the bottom frame of the structure 100, so that now the structure 100 and the pallet 900 merge together to shape a single unit of packing, transportation, and display of diverse products, which simplifies the assembly process, because it prevents the bottom frame assembly of the structure 100, without modify at all the other elements configuration that make up the structure or limit the resistance or functionality characteristics defined for the first embodiment of the invention.

What is claimed is:

1. An enhanced structure for packing, transportation and display of diverse products comprising:

an upper frame;

a bottom frame;

four side posts;

a plurality of fastening gussets;

each of said fastening gussets being defined from a moulded one piece, which defines a rounded main wall, whose side ends are projected towards its rear part with a fold in "U" shape so as to define a left insertion paddle and a right insertion paddle, each of said insertion paddles ending with a portion of material that is projected outwards and allows the easy arranging of the support and containment side posts, wherein also, in the middle of said rounded main wall a pair of slots have been shaped, while in each one of its left and right upper ends an anchor element is configured;

each of said upper and bottom frames being conformed from a pair of structural profiles folded in square shape and attached in their free ends by said fastening gussets;

wherein each of said structural profiles comprises an "L" shaped cross-section, having in its vertical wall a folding section and a flange in each of its terminal ends and in its horizontal wall a stepped configuration in an intermediate and terminal ends, comprising each of these intermediate and terminal ends a retention slot to secure a fastening gusset attaching a corner of the formed frame with a support and containment side post; and a tensor elements in an "X" shape, for each one of the front, right side, left side and rear faces of the structure attached to said anchor element of the fastening gussets.

2. The enhanced structure for packing, transportation and display of diverse products, according to claim 1, wherein said folding section formed in the vertical wall of each structural profile is defined from a plurality of weakening lines and the removal of a portion of material from said vertical wall.

3. The enhanced structure for packing, transportation and display of diverse products according to claim 1, wherein said support and containment side posts have an "L" shaped cross-section.

4. The enhanced structure for packing, transportation and display of diverse products, according to claim 1, wherein said structural profiles and the support and containment side posts are made from cardboard.

5. The enhanced structure for packing, transportation and display of diverse products, according to claim 1, wherein each of said fastening gusset is made from metal, plastic, nylamid, laminated cardboard or polymers.

6. The enhanced structure for packing, transportation and display of diverse products, according to claim 1, wherein said anchors of the fastening gusset are defined from bolts.

7. The enhanced structure for packing, transportation and display of various products, according to claim 1, wherein said anchors of the fastening gusset are defined from hooks.

8. The enhanced structure for packing, transportation and display of diverse products, according to claim 1, wherein said structure is disposed on a pallet so as to allow handling through fork lifts.

9. The enhanced structure for packing, transportation and display of diverse products, according to claim 1, wherein said pallet that supports the structure, is configured in such way that comprises four corner wedges receiving directly four support and containment side posts thereby eliminating the bottom frame of the structure.

10. An enhanced structure for packing, transportation and display of diverse products comprising:

an upper frame;

a bottom frame;

four side posts;

a plurality of fastening gussets;

each of said fastening gussets being defined from a one piece moulding, which defines a rounded main wall, whose side ends are projected towards its rear part with a fold in "U" shape so as to define a left insertion paddle and a right insertion paddle, each of said insertion paddles ending with a portion of material that is projected outwards and allows the easy arranging of the support and containment side posts, wherein, in the middle of said rounded main wall a pair of slots are formed, while in each one of its left and right upper ends an anchor element is configured;

each of said upper and bottom frames being conformed from a pair of structural profiles folded in square shape and attached in their free ends by said fastening gussets, wherein each of said structural profiles comprises an "L" shaped cross-section, having in its vertical wall with a folding section defined by a plurality of weakening lines formed in the folding section of the vertical wall and a flange in each of its terminal ends and in its horizontal wall a stepped configuration in an intermediate and terminal ends, comprising each of these intermediate and terminal ends a retention slot to secure a fastening gusset attaching a corner of the formed frame with a support and containment side post; and a tensor elements in an "X" shape, for each one of the front, right side, left side and rear faces of the structure attached to said anchor element of the fastening gussets.

* * * * *

UNITED STATES PATENT AND TRADEMARK OFFICE

CERTIFICATE OF CORRECTION

PATENT NO. : 8,251,222 B2
APPLICATION NO. : 12/872563
DATED : August 28, 2012
INVENTOR(S) : Luis Felipe Rego Garcia De Alba It is certified that error appears in the above-identified patent and that said Letters Patent is hereby corrected as shown below:

IN THE CLAIMS:

Column 7, Line 42, Claim 1:

After “comprising” insert -- in --.

Column 7, Line 45, Claim 1:

After “a tensor” Delete “elements” and insert -- element --.

Column 8, Line 49, Claim 10:

After “comprising” insert -- in --.

Column 8, Line 52, Claim 10:

After “a tensor” Delete “elements” and insert -- element --.

Signed and Sealed this
Twenty-seventh Day of November, 2012

David J. Kappos

David J. Kappos
*Director of the United States Patent and Trademark Office*